US005264811A

United States Patent [19]

Takeda

[11] Patent Number: 5,264,811

[45] Date of Patent: Nov. 23, 1993

[54] MECHANICAL LATCH DEVICE AND RELAY INCLUDING THE MECHANICAL LATCH DEVICE

[75] Inventor: Hideaki Takeda, Misato, Japan

[73] Assignee: Uchiya Thermostat Co., Saitama, Japan

[21] Appl. No.: 948,486

[22] Filed: Sep. 22, 1992

[30] Foreign Application Priority Data

Sep. 30, 1991 [JP] Japan ..... 3-251443

[51] Int. Cl.[5] ..... H01H 73/00

[52] U.S. Cl. ..... 335/18; 361/42

[58] Field of Search ..... 335/18, 131-132, 335/167-176, 177-179, 202; 361/42-50

[56] References Cited

U.S. PATENT DOCUMENTS

| | | | |
|---|---|---|---|
| 4,105,879 | 8/1978 | Tsukushi et al. | 335/131 |
| 4,574,260 | 3/1986 | Franks | 335/18 |
| 4,630,015 | 12/1986 | Gernhardt et al. | 335/18 |
| 4,719,437 | 1/1988 | Yun | 361/42 |
| 4,851,951 | 7/1989 | Foster, Jr. | 361/49 |

OTHER PUBLICATIONS

Japanese Patent Abstract No. 2-145755(A) published Jun. 1990, Motohisa Miyato, "Manufacture of Lead Frame Material Having Superior Property of Joining etc.".

Japanese Patent Abstract No. 2-299119(A) published Dec. 1990, Tamatsu Mori, "Thermal Type Trip Device For Wiring Breaker".

Japanese Patent Abstract No. 3-119630(A) published May 1991, Hiroshi Matsuura, "Circuit Breaker".

Japanese Patent Abstract No. 2-299120(A) published Dec. 1990, Tamotsu Mori, "Wiring Breaker".

*Primary Examiner*—Lincoln Donovan

*Attorney, Agent, or Firm*—Nixon & Vanderhye

[57] ABSTRACT

A mechanical latch capable of arranging a plunger PL and a latch release button straight is disclosed.

A mover MV is pushed in a direction F by pressing means including a resilient arm A provided with a movable contact CF1. The mover MV is formed with an oblique portion MVR having a section formed into a triangle. The oblique portion MVR is meshed with a gripper claw GRN and the mover MV is moved in a direction R by a spring SP to become a latch state. The plunger having a fin higher than a top of the oblique portion MVR is moved to release the meshing. The mover is moved in the direction F and the gripper is moved in the direction R to thereby release the latch.

11 Claims, 11 Drawing Sheets

MECHANICAL LATCH DEVICE AND RELAY INCLUDING THE MECHANICAL LATCH DEVICE

FIELD OF THE INVENTION

The present invention relates to a mechanical latch device and a relay including the mechanical latch device.

PRIOR ART

FIG. 17 is a sectional view schematically illustrating an example of a conventional mechanical latch device of a relay.

A plunger 2 disposed movably within a solenoid 1 is urged to be moved in a direction a to be separated from the solenoid 1 by means of a spring 3. A resilient plate 4 having an opening 4*a* formed therein is fixedly mounted to the plunger 2. A movable contact plate 5 having a claw 5*a* capable of being meshed with the opening 4*a* of the resilient plate 4 is fixedly mounted at one end 5*b* thereof to a housing of the relay and the claw 5*a* is urged to be moved toward the resilient plate 4 in the direction b by means of the resilient force of the movable contact plate itself. The movable contact plate 5 includes a movable contact 5*c*. When the relay is conductive, the movable contact 5*c* is brought into contact with a fixed contact 6*a* of a fixed contact plate 6 which is fixedly mounted to the housing of the relay. When a current flows in the solenoid 1, the plunger 2 is pulled into the solenoid, so that the claw 5*a* is meshed with the opening 4*a*. At this time, the fixed contact 6*a* is separated from the movable contact 5*c* by means of the resilient force of the movable contact plate 5 so that the relay is changed to the cut-off state. This state continues after the current flowing in the solenoid is extinguished.

This state is released by pushing a button 7 capable of being moved in the direction perpendicular to the moving direction of the plunger. The button 7 is urged to be separated from the resilient plate 4 in the direction c by a spring 8 and when the button 7 is pushed, a top thereof presses the resilient plate 4 to deform the plate. Consequently, the meshing or engagement of the claw 5*a* with the opening 4*a* is released, so that the resilient plate 4 is moved to be separated from the solenoid 1 by the resilient force of the spring 3 and is returned to its original state.

In the conventional mechanical latch device, since the moving direction of the plunger is perpendicular to the moving direction of the button, there is limitation in a layout within the housing of the relay and it is difficult to make small the device.

OBJECT AND SUMMARY OF THE INVENTION

It is a first object of the present invention to provide a mechanical latch capable of causing the moving direction of the plunger to coincide with the moving direction of the button for releasing the latch state so that the solenoid, the plunger and the button can be disposed substantially straight.

It is a second object of the present invention to provide an actuator capable of being made small by disposing the actuator, the plunger and the button for releasing the latch state substantially straight to reduce spatial interference of a mechanical portion and an electrical circuit to thereby improve the degree of freedom in design.

The first subject is solved by the mechanical latch comprising a plunger including a plunger rod and a plunger fin disposed at one end of the plunger rod, a mover including a mover central hole into which the vicinity of the plunger fin of the plunger is inserted, a mover groove through which the plunger fin passes and a mover oblique projection having a section formed into a substantial triangle having an apex higher than the height of the plunger fin, a long easy slope and a short end surface, a gripper including a gripper plate made of resilient material and capable of being meshed with the mover oblique projection by means of a gripper claw formed at an end thereof and a gripper button for pushing the gripper plate toward the plunger rod, pressing means for urging to move the mover toward the plunger at all times, and a spring for urging to separate the gripper from the plunger at all times, and having a latch released state where the mover is pressed by the pressing means to be moved toward the plunger rod, a first intermediate state where the gripper claw is slided along the long easy slope of the mover oblique projection by pressing the gripper button toward the plunger, a second intermediate state where the gripper claw exceeds the top of the mover oblique projection and is meshed with the short end surface of the mover oblique projection so that the gripper grasps the mover and consequently the mover and the gripper are moved to be separated from the plunger by the spring, a latch state where the moved state of the mover and the gripper is maintained by the spring, and a third intermediate state where when the plunger rod is moved to be separated from the gripper, the gripper plate is pushed up by the plunger fin to release the meshing or engagement of the gripper claw and the short end surface of the mover oblique projection and the mover is moved toward the plunger rod by the pressing means to return the latch released state.

The second subject is solved by the relay having a mechanical latch device comprising the mechanical latch device, an actuator for moving the plunger rod of the mechanical latch, a fixed contact fixedly mounted to a housing, an arm having resilience and having an end fixedly mounted to the housing, and a movable contact fixedly mounted to the other end of the arm, whereby the arm acts as pressing means of the mechanical latch and the mover of the mechanical latch is always urged to be moved toward the plunger rod by resilient force of the arm.

When the gripper button is pushed, the latch released state is changed to the latch state by the spring, and when the plunger rod is moved to be separated from the gripper, the latch state is transferred to the latch released state.

PREFERRED EMBODIMENT OF THE INVENTION

Figure 1:
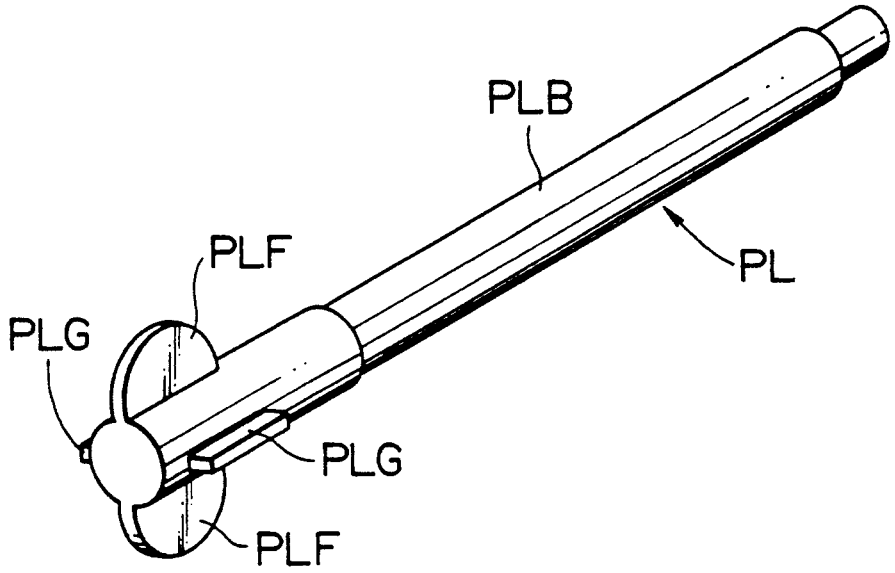
FIG. 1 is a perspective view of a plunger.

FIG. 1 is a perspective view of a plunger PL.

Substantially semicircular plunger fins PLF are disposed symmetrically in the vertical direction at one end of a plunger rod PLB of the plunger and a pair of semicircular plunger guides PLG are disposed perpendicularly to the plunger fins.

Figure 2:
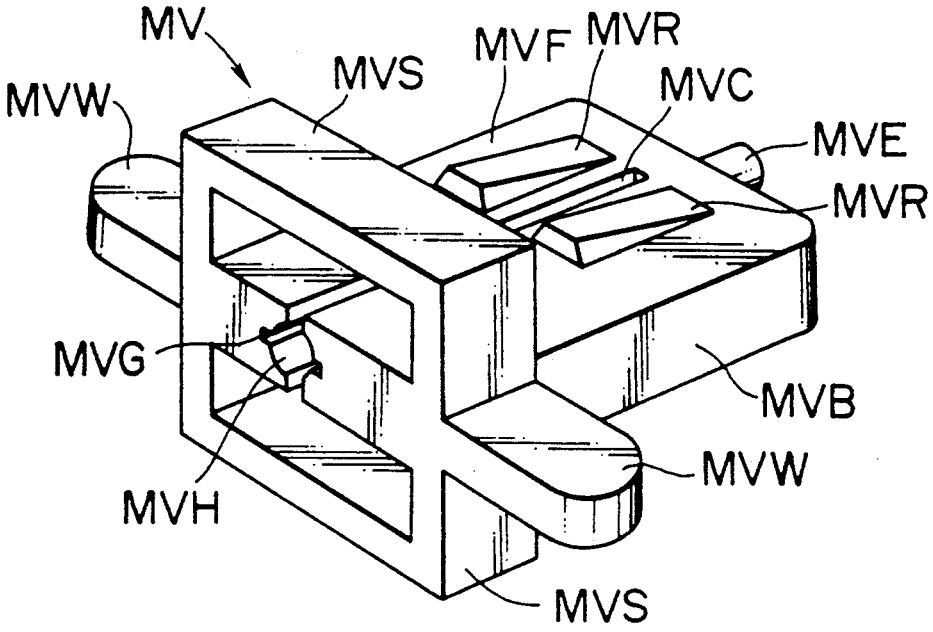
FIG. 2 is a perspective view of a mover.

FIG. 2 is a perspective view of a mover MV.

A mover central hole MVH into which an end of the plunger PL is inserted is formed in the middle of a mover base MVB. Grooves MVG for the plunger guide PLGS and mover grooves MVC for the plunger fins PLF are formed in the mover central hole MVH. The plunger guides PLG are slidably moved along the grooves MVG.

The Mover MV includes mover oblique projections MVR having a section formed into a substantial triangle and including a long easy slope and a short end surface.

Further, disposed at one end of the mover MV are mover wings MVW extending in the direction perpendicular to the mover central hole MVH and substantially rectangular mover stoppers MVS extending in the direction perpendicular to the mover central hole MVH and the mover wings MVW. In addition, a substantially circular mover end MVE is disposed at the other end of the mover MV. The mover stopper MVS and the mover end MVE function as a stopper of the mover.

Figure 3:
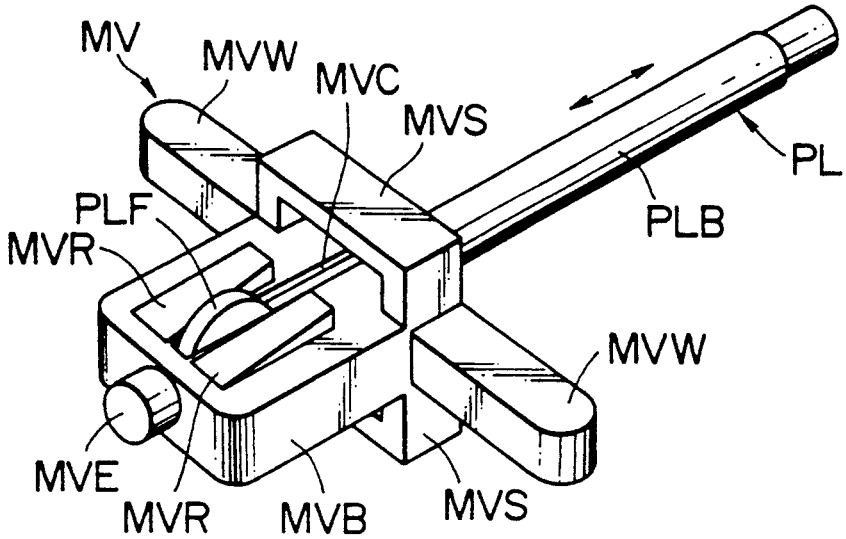
FIG. 3 is a perspective view of the mover inserted into the plunger.

FIG. 3 is a perspective view showing the mover MV into which the plunger is inserted. The mover is moved while using the plunger as a guide.

The mover MV shown in FIG. 3 is viewed from the rear side of the mover of FIG. 2.

The plunger fins PLF are moved in the mover grooves MVC. As apparent from FIG. 3, the height of the plunger fins PLF are higher than that of an apex of the triangle of the mover oblique projections MVR.

Figure 4:
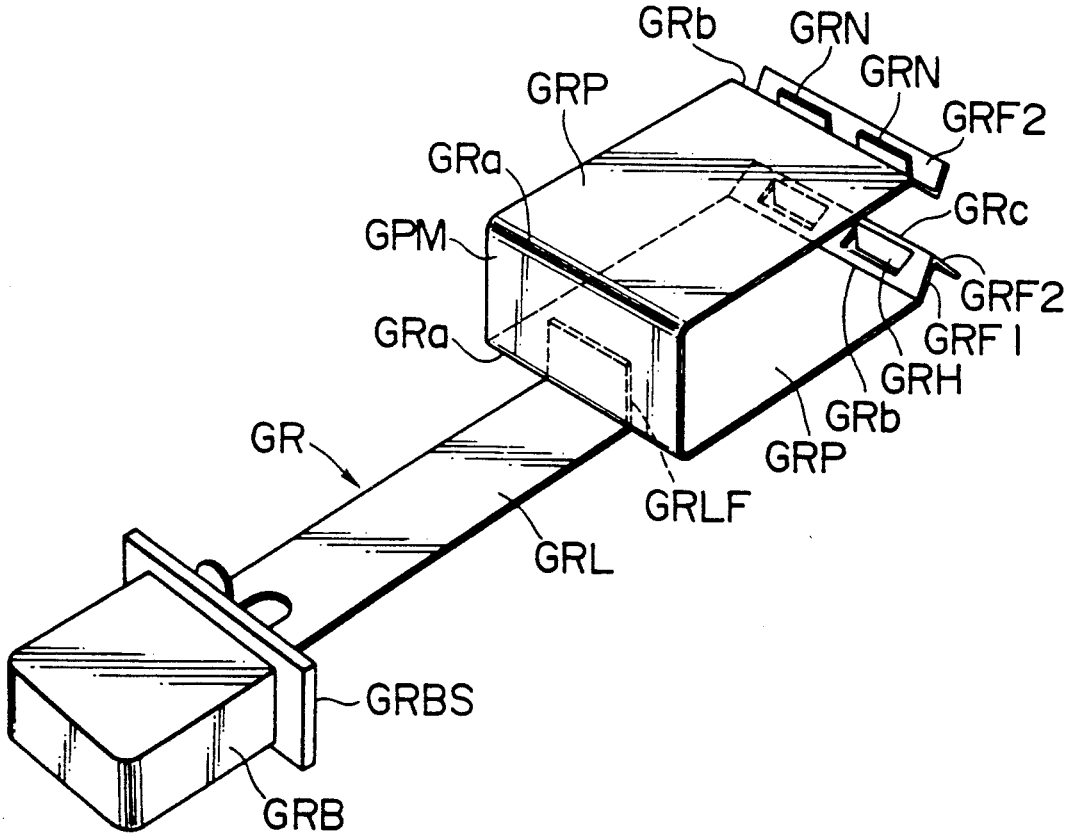
FIG. 4 is a perspective view of a gripper.

FIG. 4 is a perspective view of the gripper GR.

The gripper GR includes a gripper plate GRP, a gripper button GRB having a flange GRBS for a gripper button stop, and a gripper lever GRL connecting the gripper plate GRP and the gripper button GRB.

The gripper plate GRP is formed by bending a single metal plate having resilience at two approximately middle positions GRa in the same direction by 90 degrees. A gripper plate middle portion GPM is fixedly attached to a gripper lever fixing portion GRLF of the gripper lever GRL.

The gripper plate GRP is further bent at a position GRb near its top by about 45 degrees in the same direction as the position GRa to form first gripper inclined portions GRF1.

The gripper plate GRP is further bent at a position GRc nearer the top of the gripper plate GRP than the position GRb by about 90 degrees in the direction opposite to the position GRb to form second gripper inclined portions GRF2. That is, folds GRT are formed at position CRc.

Figure 5:
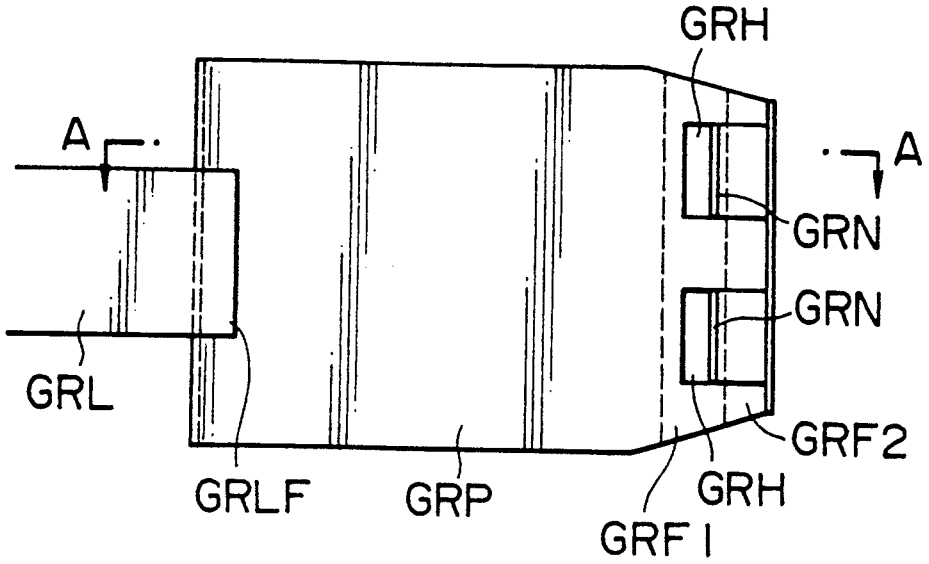
FIG. 5 is a plan view of a gripper plate.
Figure 6:
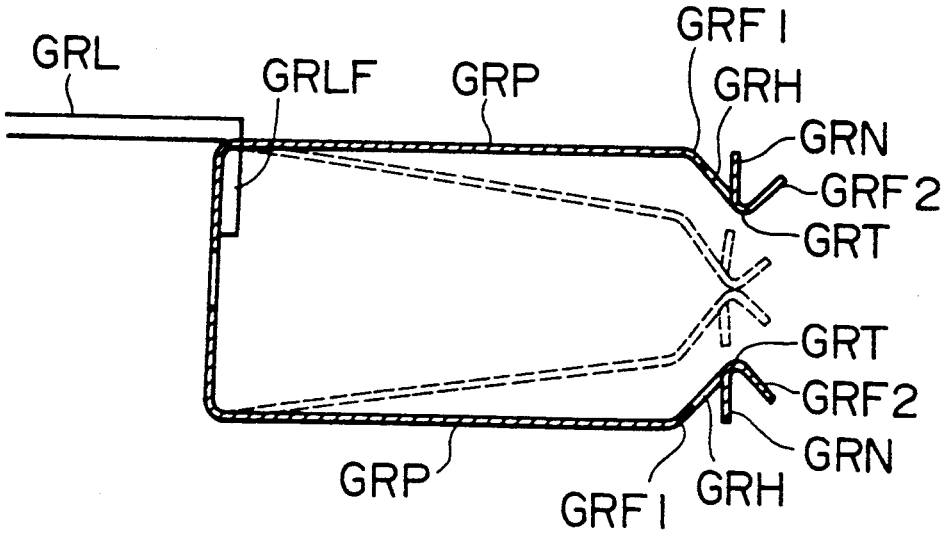
FIG. 6 is a sectional view taken along line A—A of the gripper plate of FIG. 5.

As shown in FIGS. 5 and 6, the first gripper inclined portion GRF1 is formed with gripper claws GRN and gripper holes GRH by cutting three sides and bending one side in the same direction as the position GRc.

The gripper claws GRN and the gripper holes GRH are formed to be able to be meshed with the mover oblique projections MVR of the mover MV.

Figure 8:
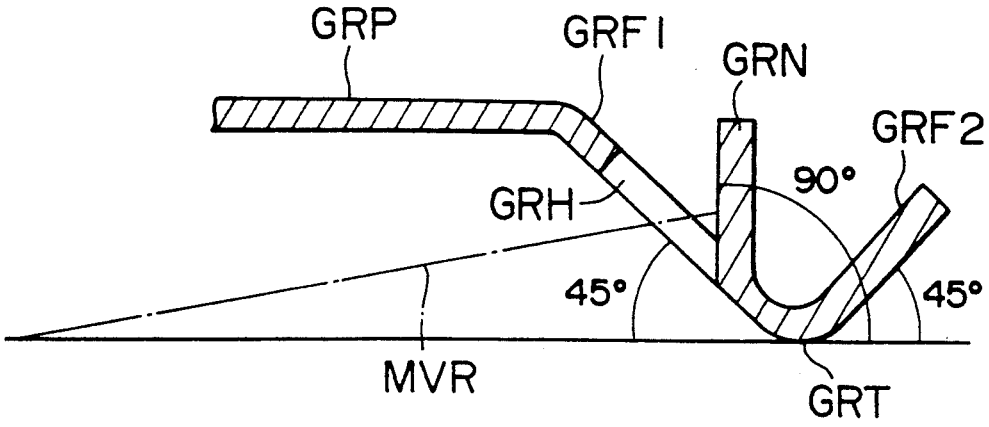
FIG. 8 is a partially enlarged sectional view of the gripper claw in a latch state.

In the meshed state, as shown in FIG. 8, a part of the mover oblique portion R passes through the gripper hole GRH and the short end surface thereof abuts against the gripper claw GRN.

The second gripper inclined portion GRF2 is inclined at an angle of 45 degrees with respect to a mover surface MVF. Accordingly, when the gripper plate GRP is moved in the direction shown by an arrow of FIG. 7, the gripper plate GRP is gradually deformed and is moved up on the easy slope of the mover oblique portion MVR while sliding on the slope.

The gripper claw GRN and the mover oblique portion MVR are formed so that the gripper claw GRN and the mover oblique portion MVR are perpendicular to the mover surface MVF. Accordingly, when the gripper claw GRN exceeds the top of the mover oblique portion MVR, the gripper claw and the mover oblique portion are engaged or meshed with each other by the resilient force of the gripper plate GRP as shown in FIG. 8.

Operation of the mechanical latch device structured by combining the plunger PL, the mover MV and the gripper GR having the above-described structure is now described.

Figure 9:
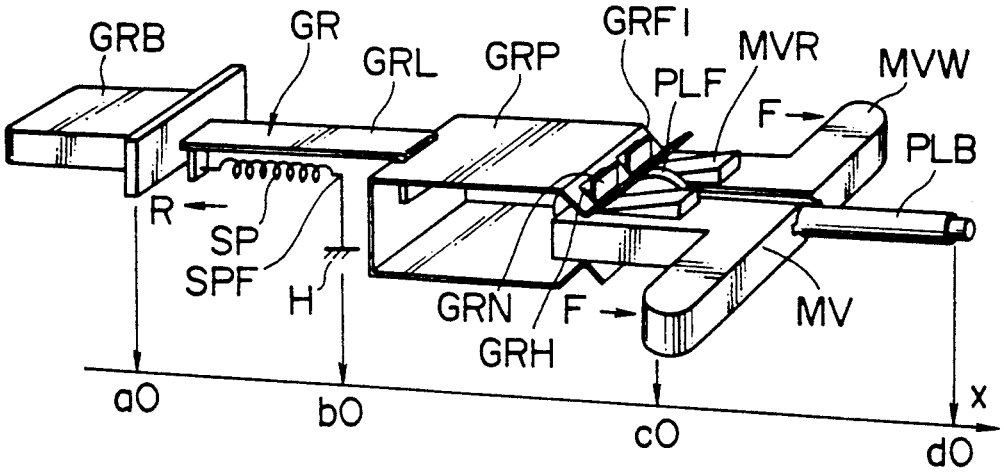
FIG. 9 is a perspective view of a main portion of a mechanical latch device in a latch released state.

FIG. 9 schematically illustrates the mechanical latch in the latch released state.

The mover wings MVW of the mover MV are always urged to be moved in the direction of arrow F of FIG. 9 by means of pressing means not shown. Further, the gripper claws GRN are not meshed with the mover oblique portion MVR. Accordingly, the mover MV is moved in the direction of arrow F of FIG. 9 until the mover stopper MVS not shown in FIG. 9 abuts against the housing also not shown in FIG. 9.

Consequently, the plunger rod PLB is inserted to the deepest portion of the mover central hole MVH and the top of the plunger fins PLF is positioned nearer the gripper GR than the top of the mover oblique portion MVR.

The gripper GR is urged to be moved in the direction of arrow R of FIG. 9, that is, to be separated from the mover MV by means of the spring SP disposed in parallel to the gripper lever GRL. Consequently, the gripper GR is moved until the gripper button stopping flange GRBS not shown in FIG. 9 abuts against the housing.

It is assumed that respective positions of the gripper GR, the mover MV and the plunger PL are a0, c0 and d0 with respect to a position b0 of the spring fixing portion SPF as a representative of a position of the housing at this state with the moving direction of the gripper GR, the mover MV and the plunger PL being an x axis.

Figure 10:
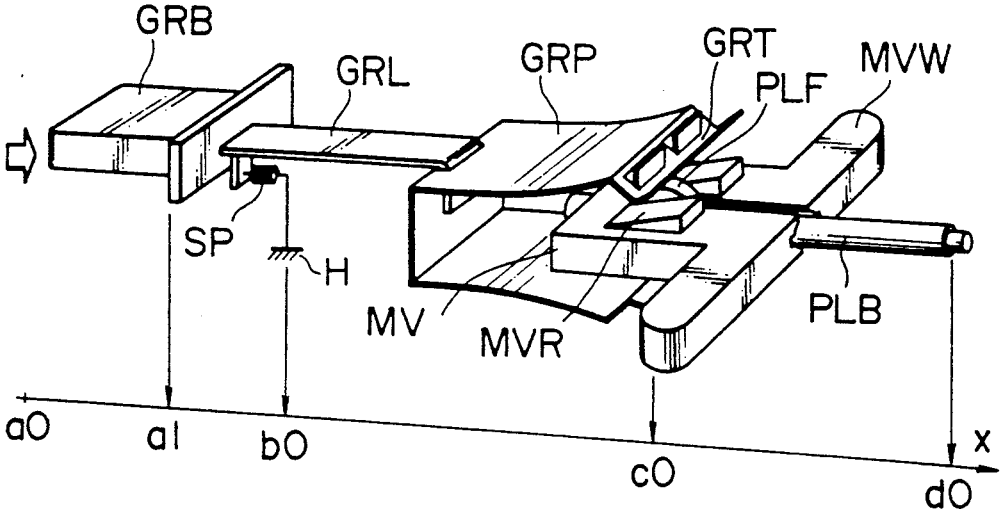
FIG. 10 is a perspective view of a main portion of the mechanical latch device in the first intermediate state.

FIG. 10 schematically illustrates a first intermediate state.

Figure 7:
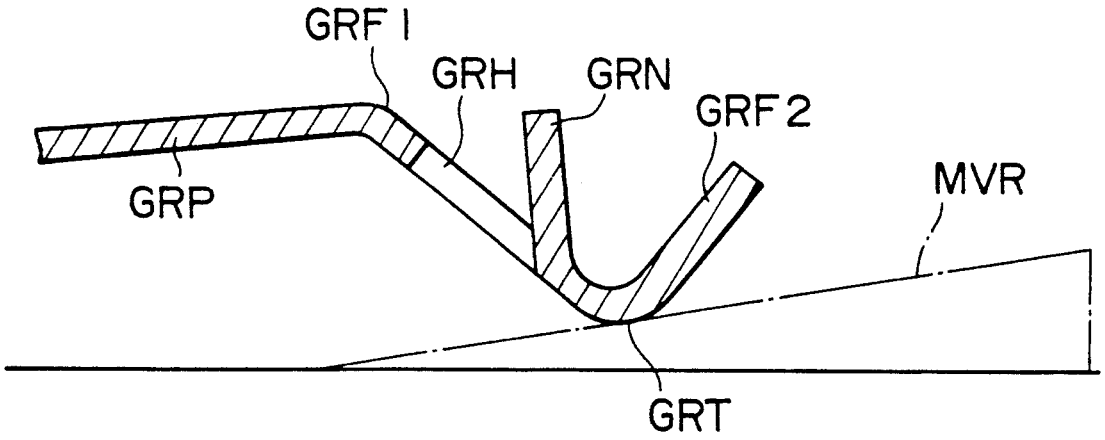
FIG. 7 is a partially enlarged sectional view of a gripper claw in a first intermediate state.

When the gripper button GRB of the gripper GR is pushed, the gripper GR is moved in the direction of the mover MV. Thus, as shown in FIG. 7, the gripper plate GRP is moved up on the long easy slope of the mover oblique portion MVR while being slided on the slope.

At this state, the positions of the mover and the plunger are not changed to be maintained to c0 and d0, respectively, and only the position a1 of the gripper is changed.

When the gripper plate GRP exceeds the top of the easy slope, the gripper claw GRN is meshed or engaged with the mover oblique portion MVR as shown in FIG. 8.

Thus, when the gripper button GRB is stopped from being pushed, the gripper GR is moved to be separated from the plunger PL, that is, in the direction of arrow R of FIG. 9 by means of the spring SP.

At this time, since the gripper claw GRN is meshed with the mover oblique portion MVR, the mover MV is also moved to be separated from the plunger PL together with the gripper GR.

The second intermediate state where the mover MV and the gripper GR are moved to be separated from the plunger PL is terminated by the fact that the gripper button stopping flange GRBS not shown abuts against the housing not shown to be changed to the latch state.

Figure 11:
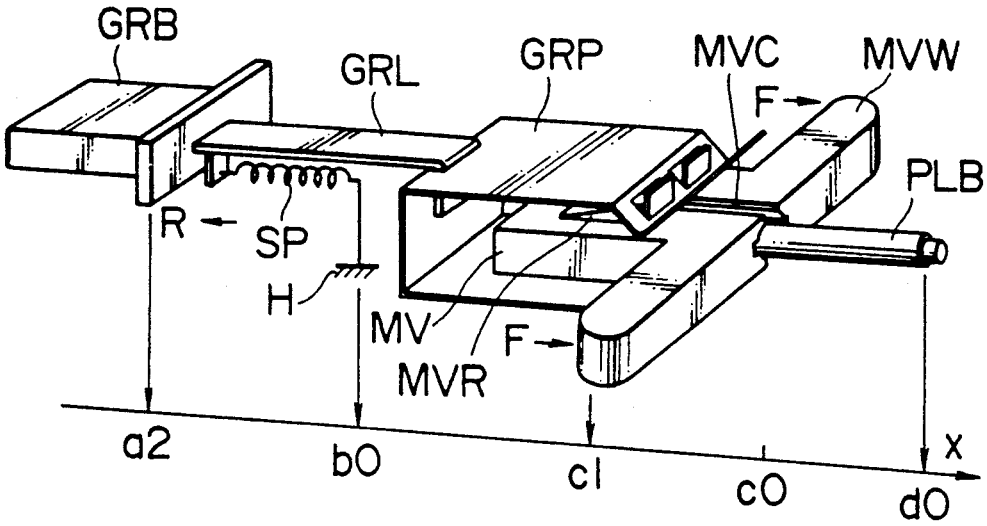
FIG. 11 is a perspective view of a main portion of the mechanical latch device in the latch state.

FIG. 11 shows the latch state. The mover oblique portion MVR is meshed with the gripper claw GRN of the gripper plate GRP and the gripper GR is being moved in the direction of arrow R by the larger force in the direction of arrow R of the spring SP than the force in the direction of arrow F by pressing means not shown. Accordingly, the mover MV is moved from position c0 to c1 and the gripper GR is moved to position a2.

Figure 12:
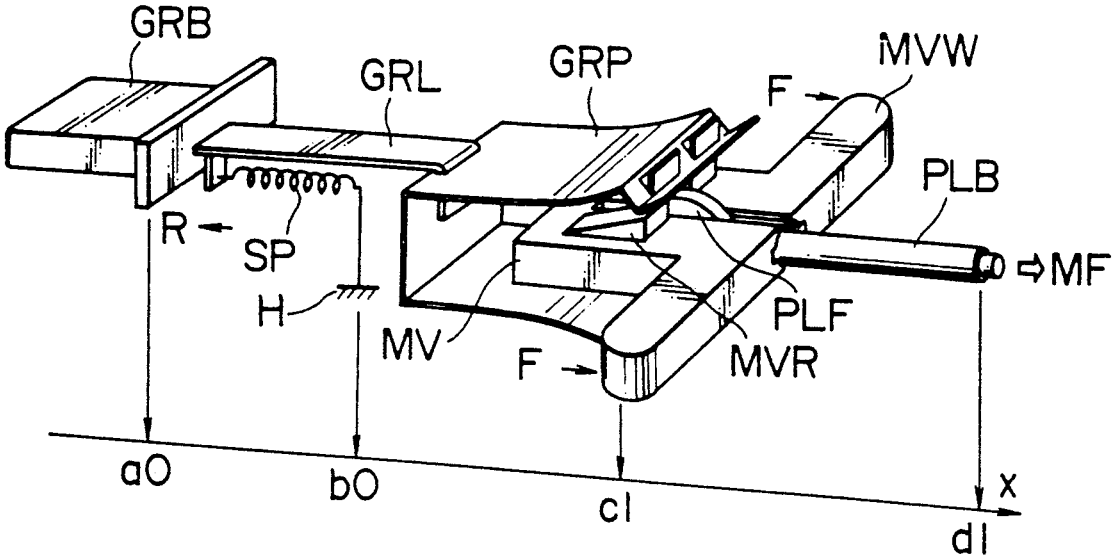
FIG. 12 is a perspective view of a main portion of the mechanical latch device in a third intermediate state.

When the plunger rod PLB is pulled in the direction of arrow MF of FIG. 12 in the state where the mover MV is meshed with the gripper GR, the gripper plate GRP is resiliently deformed by the semicircular plunger fin PLF. Since the height of the plunger fin PLF is higher than the height of the top of the mover oblique portion, the meshing or engagement of the mover MV and the gripper GR is released. Just before the meshing or engagement is released, the position of the gripper GR is a2 and the position of the mover MV is not changed and remains c1 with only the plunger PL being moved to position d1.

When the meshing or engagement of the mover MV and the gripper GR is released, the mover MV is moved in the direction of arrow F by the force in the direction of arrow F by pressing means not shown to be returned to the position c0 and the gripper GR is moved in the direction of arrow R by the force in the direction of arrow R by the spring SP to be returned to the position a0, to thereby return to the lock released state of FIG. 9 finally.

A relay including the mechanical latch device according to the present invention is shown in FIGS. 13 to 16.

A solenoid coil SOLN, a plunger rod PLB fitted into the solenoid coil to be moved by magnetic force of the solenoid coil, a mover MV, a gripper GR including a gripper plate GRP, a gripper lever GRL and a gripper button GRB, and a spring SP are disposed within a housing H in a line in the x direction.

The mechanical latch device included in the relay shown in FIGS. 13 to 16 is the same as that of FIGS. 9 to 12.

In this case, the plunger PL is moved by magnetic force of the solenoid SOLN and the pressing means for pressing the mover MV to the plunger PL is realized by a pair of resilient arms A on which a movable contact is provided.

The resilient arm A is fixedly mounted at an end AF thereof tothe housing H and terminals T1 and T2 are disposed at the end. Lead wires for a power supply, for example, are connected to the terminals. Movable contacts CM1 and CM2 are disposed at the other end of the resilient arm A.

Fixed contacts CF1 and CF2 fixedly mounted in the housing H are disposed in a position opposite to the movable terminal. The fixed contacts CF1 and CF2 are connected to terminals T3 and T4. Lead wires for a load, for example, are connected to the terminals T3 and T4.

The resilient arm A includes a semicircular arm projection AB formed in the central portion thereof and the arm projection AB presses a semicylindrical surface of the top of the mover wing MVW of the mover MV. That is, the mover wing MVW and the resilient arm A are in contact with each other through a convex curved surface.

The arm A is inclined with respect to the moving direction of the plunger to increase the resilient force of the resilient arm A when the plunger is moved in the direction of arrow R.

A pair of resilient arms A are symmetrically disposed on both sides of the mover MV so that a resultant force of pressing the mover MV by the resilient arms A is directed to the direction of arrow F.

Figure 15:
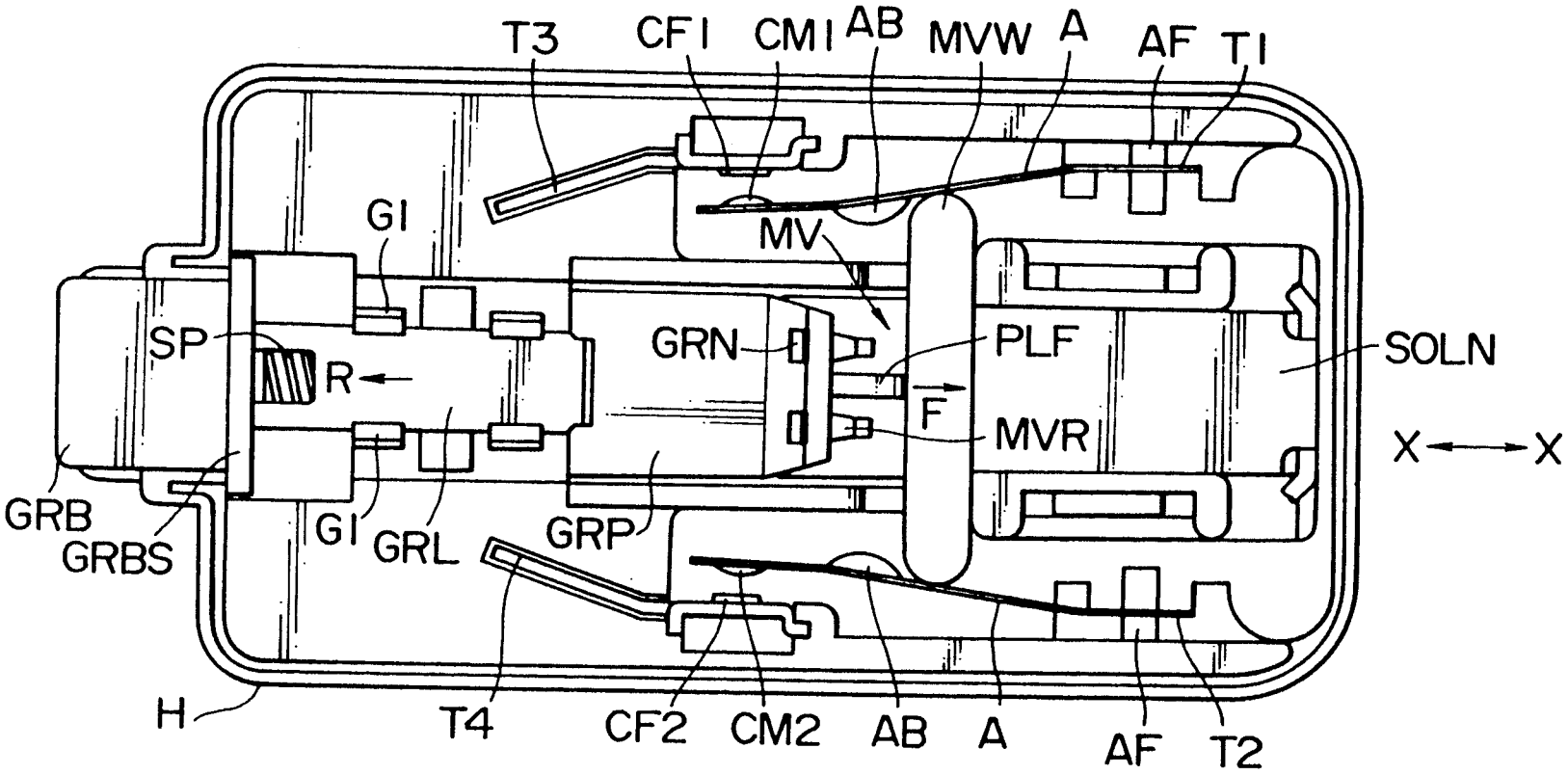
FIG. 15 is a plan view schematically illustrating the mechanical latch device of the relay of FIG. 13 in the latch released state.

Accordingly, in the latch released state where the gripper claw GRN is not meshed with the mover oblique portion MVR, the mover MV is moved in the direction of arrow F by the force of the resilient arm A. In this state, as shown in FIG. 15, the movable contacts CM1 and CM2 are separated from the fixed contacts CF1 and CF2 by the resilient force of the resilient arm A itself. That is, the terminals T1 and T2 of the relay are cut off from the terminals T3 and T4, respectively.

When the gripper button GRB is pushed, the state of the relay is shifted to the latch state through the processes described in the paragraphs 0027 to 0029 of this specification.

Figure 16:
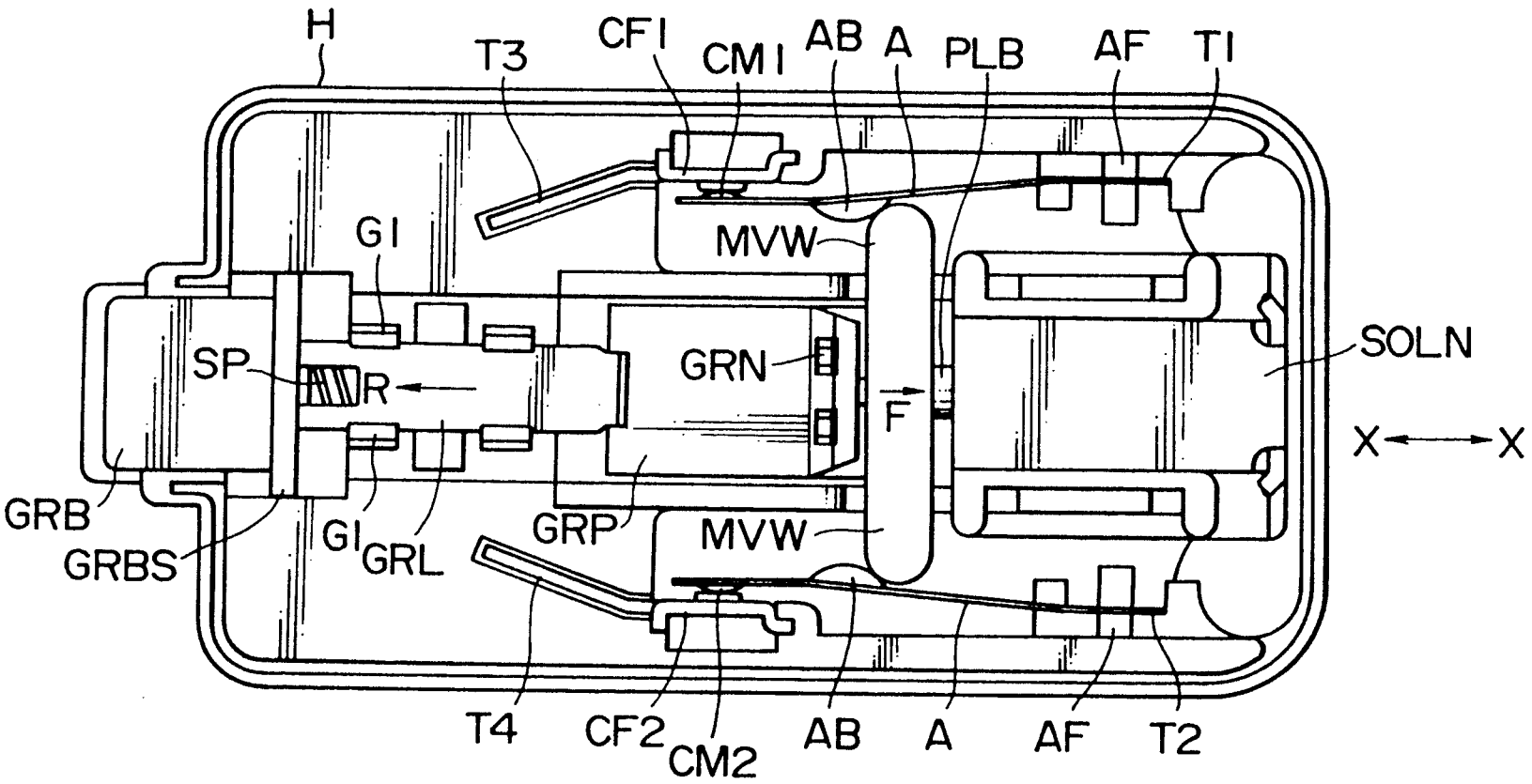
FIG. 16 is a plan view schematically illustrating the mechanical latch device of the relay of FIG. 13 in the latch state.
Figure 17:
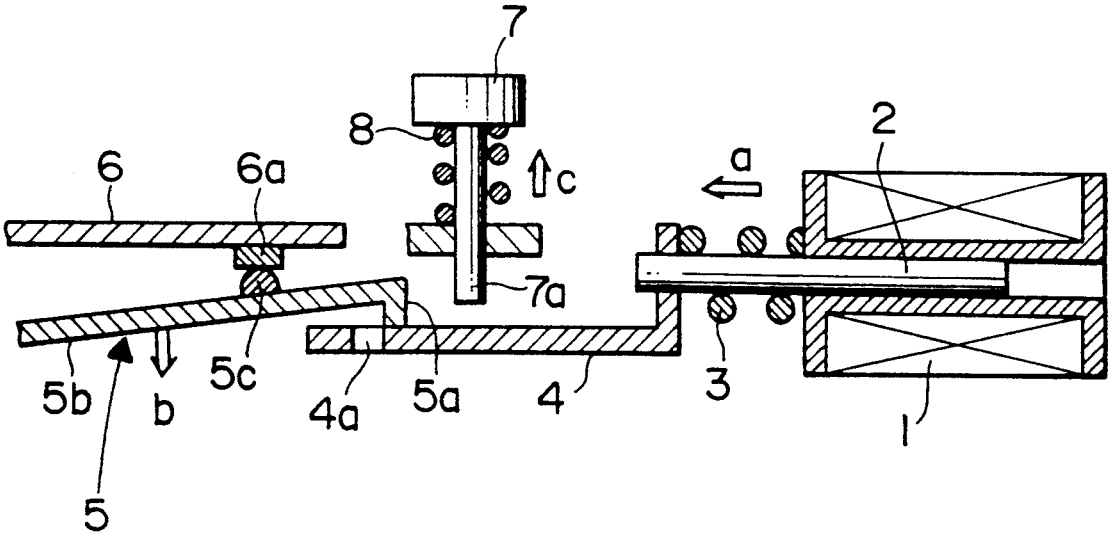
FIG. 17 PRIOR ART
FIG. 17 is a sectional view schematically illustrating a conventional mechanical latch device.

In the latch state, since the mover MV is moved in the direction of arrow R by the spring SP, the mover wing MVW presses the arm projection AB. Consequently, the arm A is resiliently deformed and the movable contacts CM1 and CM2 are brought into contact with the fixed contacts CF1 and CF2, respectively, as shown in FIG. 16. That is, the terminals T1 and T2 of the relay are electrically connected to the terminals T3 and T4.

When a current flows through the solenoid SOLN, the plunger rod PLB is moved in the direction of arrow F. The solenoid SOLN is controlled by an electric circuit EC connected through a lead wire L thereto.

Consequently, the state of the relay is returned to the latch released state shown in FIG. 15 through the processes described in the paragraphs 0030 to 0031 of this specification. This state continues even if the current is stopped.

The moving direction of the plunger and the moving direction of the button can be arranged substantially straight.

Consequently, it is easy to spatially separate the electric circuit portion EC from the mechanical latch portion.

Figure 13:
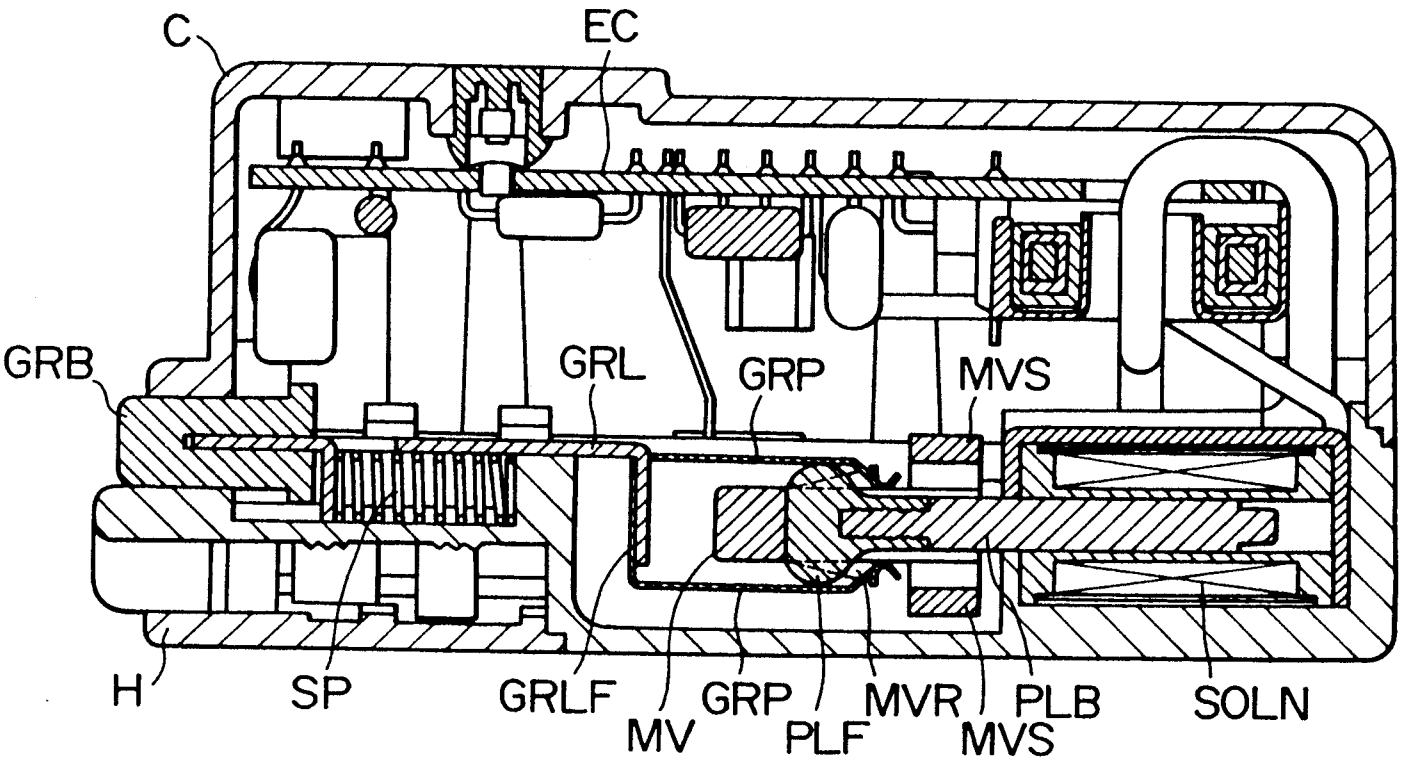
FIG. 13 is a sectional view of a relay including the mechanical latch device according to the present invention.
Figure 14:
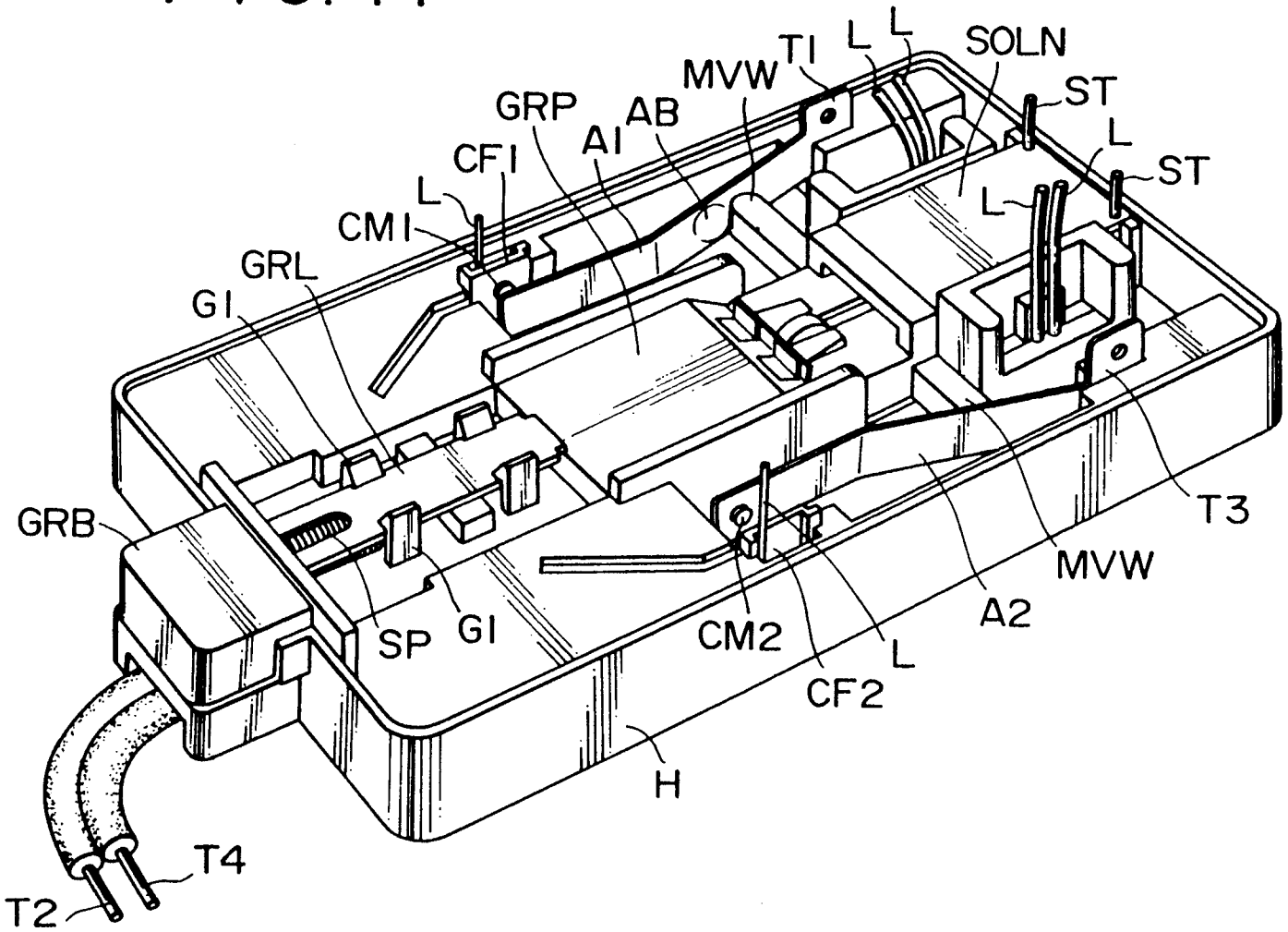
FIG. 14 is a perspective view of the relay of FIG. 13 with an electronic circuit portion being removed.

For example, as shown in FIG. 13, since the mechanical latch portion can be accommodated in the lower portion of the housing H and the electric circuit portion can be accommodated in the upper portion of the housing H, the degree of freedom in the layout design of elements in the housing is improved and the whole structure is easily made small.

LIST OF PARTS

A1, A2: resilient arm
AB: arm projection
AF: an end of arm
CF, CF2: fixed contact
CM1, CM2: movable contact
F: direction of pressing the mover by pressing means
GR: gripper
GRB: gripper button
GRBS: gripper button stopping flange
GRH: gripper hole
GRL: gripper lever
GRLF: gripper lever fixing portion
GRN: gripper claw
CRP: gripper plate
GRF1: first gripper inclined portion
GRF2: second gripper inclined portion
GRa, GRb, GRc: bent portion of gripper
GRM: central portion of gripper plate
H: housing
MF: direction of moving plunger by solenoid
MV: mover
MVB: mover base
MVC: mover groove
MVE: mover end
MVF: mover surface
MVG: mover guide
MVH: mover central hole
MVR: mover oblique projection
MVS: mover stopper
MVW: mover wing
PL: plunger
PLB: plunger rod
PLF: plunger fine
PLG: plunger guide
R: direction of pressing gripper by spring
SOLN: solenoid
SPF: spring fixing portion
T1, T2, T3, T4: terminal
a0, a1, a2: position of lever button as representative position of lever
b0: position of spring fixing portion as representative position of housing
c0, c1: position of mover wing as representative position of mover
d0, d1: position of a point of plunger as representative position of plunger
x: coordinate axis having b0 as the origin for a0, a1, a2, c0, c1, d0 and d1

I claim:

1. A mechanical latch comprising a plunger including a plunger rod and a plunger fin disposed at one end of said plunger rod, a mover including a mover central hole into which the vicinity of said plunger fin of said plunger is inserted, a mover groove through which said plunger fin passes and a mover oblique projection having a section formed into a substantial triangle having an apex lower than the height of said plunger fin, a long easy slope and a short end surface, a gripper including a gripper plate made of resilient material and capable of being meshed with said mover oblique projection by means of a gripper claw formed at an end thereof and a gripper button for pushing said gripper plate toward said plunger rod, pressing means for urging to move said mover toward said plunger at all times, and a spring for urging to separate said gripper from said plunger at all times, and having a latch released state where saod mover is pressed by said pressing means to be moved toward said plunger rod, a first intermediate state where said gripper claw is slided along the long easy slope of said mover oblique projection by pressing said gripper button toward said plunger, a second intermediate state where said gripper claw exceeds the top of said mover oblique projection and is meshed with the short end surface of said mover oblique projection so that said gripper grasps said mover and consequently said mover and said gripper are moved to be separated from said plunger by said spring, a latch state where the moved state of said mover and said gripper is maintained by said spring, and a third intermediate state where when said plunger rod is moved to be separated from said gripper, said gripper plate is pushed up by said plunger fin to release the meshing or engagement of said gripper claw and said short end surface of said mover oblique projection and said mover is moved toward said plunger rod by said pressing means to return the latch released state.

2. A mechanical latch device according to claim 1, wherein said mover is moved while using said plunger as a guide.

3. A mechanical latch device according to claim 1, wherein said plunger includes a pair of rectangular plunger guides and said mover central hole includes a groove for said plunger guide, said plunger guide being slided along said groove.

4. A mechanical latch device according to claim 1, wherein said mover includes a mover wing extending in a direction perpendicular to the moving direction of said plunger and said pressing means presses said mover wing.

5. A mechanical latch device according to claim 1, wherein said pressing means includes a resilient arm having a movable contact formed at one end thereof.

6. A mechanical latch device according to claim 1, wherein said pressing means includes a resilient arm having a movable contact formed at one end thereof and said mover includes a mover wing extending in a direction perpendicular to the moving direction of said plunger, said mover wing being pressed by said pressing means.

7. A mechanical latch device according to claim 6, wherein said mover wing comes into surface-contact with said resilient arm.

8. A mechanical latch device according to claim 6, wherein a portion where said mover wing comes into contact with said resilient arm is a convex curved surface.

9. A mechanical latch device according to claim 6, wherein said resilient arm is inclined with respect to the moving direction of said plunger to increase resilient force of said resilient arm when said plunger is moved toward said gripper.

10. A relay having a mechanical latch device comprising said mechanical latch device according to claim 1, an actuator for moving said plunger rod of said mechanical latch, a fixed contact fixedly mounted to a housing, an arm having resilience and having an end fixedly mounted to the housing, and a movable contact fixedly mounted to the other end of said arm, whereby said arm acts as pressing means of said mechanical latch and said mover of said mechanical latch is always urged to be moved toward said plunger rod by resilient force of said arm.

11. An actuator having said mechanical latch device according to claim 10, wherein said actuator includes a solenoid coil.

* * * * *